US011378088B2

(12) United States Patent
Sommer et al.

(10) Patent No.: US 11,378,088 B2
(45) Date of Patent: Jul. 5, 2022

(54) CONTROL SYSTEM FOR CENTRIFUGAL COMPRESSOR

(75) Inventors: Steven T. Sommer, York, PA (US); Curtis Christian Crane, York, PA (US); Florin Iancu, Silver Spring, MD (US); John Trevino, Jr., York, PA (US); Robert E. Stabley, Dallastown, PA (US); Gregory K. Beaverson, York, PA (US); Eric J. Smyder, York Haven, PA (US); Patrick C. Marks, York, PA (US); Rudy Chervil, Mountville, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 816 days.

(21) Appl. No.: 13/375,986

(22) PCT Filed: Jun. 4, 2010

(86) PCT No.: PCT/US2010/037398

§ 371 (c)(1),
(2), (4) Date: Dec. 2, 2011

(87) PCT Pub. No.: WO2010/141815

PCT Pub. Date: Dec. 9, 2010

(65) Prior Publication Data

US 2012/0100011 A1 Apr. 26, 2012

Related U.S. Application Data

(60) Provisional application No. 61/184,551, filed on Jun. 5, 2009.

(51) Int. Cl.
*F04D 27/02* (2006.01)
*F04B 49/06* (2006.01)
(Continued)

(52) U.S. Cl.
CPC ..... *F04D 27/02* (2013.01); *F04D 27/001* (2013.01); *F04D 27/0246* (2013.01);
(Continued)

(58) Field of Classification Search
CPC .. F04D 27/0261; F04D 27/02; F04D 27/0246; F04D 27/0207; F04D 27/0223; F04D 27/0284; Y02B 30/70; F04B 49/06
(Continued)

(56) References Cited

U.S. PATENT DOCUMENTS 3,876,326 A * 4/1975 Weitz ..... 415/17
3,901,620 A * 8/1975 Boyce ..... 415/1
(Continued)

FOREIGN PATENT DOCUMENTS

CN 1218551 A 6/1999
CN 101368515 A 2/2009
(Continued)

OTHER PUBLICATIONS

Boyce, M.P. et al., 1983, "Tutorial Session on Practical Approach to Surge and Surge Control Systems," Proceedings of the Twelfth Turbomachinery Symposium, Texas A&M University Turbomachinery Laboratories.*

(Continued)

*Primary Examiner* — Dominick L Plakkoottam
*Assistant Examiner* — Charles W Nichols
(74) *Attorney, Agent, or Firm* — Fletcher Yoder, P.C.

(57) ABSTRACT

A control system is provided that can identify the occurrence of a single surge cycle in centrifugal compressor using various methods and devices. Once the occurrence of a single surge cycle is identified, the control system can take remedial action to respond to the surge cycle, such as by
(Continued)

adjusting the position of a variable geometry diffuser, and restore the centrifugal compressor to stable operation.

2 Claims, 10 Drawing Sheets

(51) Int. Cl.
*F04D 29/058* (2006.01)
*F04D 27/00* (2006.01)

(52) U.S. Cl.
CPC ..... *F04D 27/0261* (2013.01); *F04D 29/058* (2013.01); *F05D 2270/335* (2013.01)

(58) Field of Classification Search
USPC ..... 417/18–24, 26–29, 44.1, 279
See application file for complete search history.

(56) References Cited

U.S. PATENT DOCUMENTS 4,164,035 A * 8/1979 Glennon et al. ..... 701/100
4,399,548 A 8/1983 Castleberry
4,503,684 A * 3/1985 Mount ..... F04D 27/0246 415/14
4,545,198 A 10/1985 Yoshida
4,581,900 A * 4/1986 Lowe et al. ..... 62/228.1
5,499,301 A * 3/1996 Sudo ..... G10K 11/178 381/71.3
5,553,997 A 9/1996 Goshaw et al.
5,746,062 A * 5/1998 Beaverson et al. ..... 62/228.3
5,894,736 A 4/1999 Beaverson et al.
5,924,847 A * 7/1999 Scaringe ..... F04D 29/058 417/42
6,092,029 A * 7/2000 Bently ..... 702/56
6,332,362 B1 * 12/2001 Lee ..... F24F 11/30 73/659
6,463,748 B1 * 10/2002 Benedict ..... F04D 27/0284 62/228.1
6,581,399 B2 6/2003 Benedict et al.
6,857,845 B2 2/2005 Stabley et al.
7,035,718 B2 * 4/2006 Jensen et al. ..... 700/280
7,356,999 B2 4/2008 Bodell, II et al.
7,824,148 B2 11/2010 Tetu et al.
2002/0161550 A1 * 10/2002 Bharadwaj et al. ..... 702/182
2004/0025523 A1 2/2004 Bodell, II et al.
2004/0037693 A1 2/2004 Stabley et al.
2005/0076656 A1 * 4/2005 Bodell et al. ..... 62/83
2005/0165510 A1 7/2005 Jensen et al.
2005/0287010 A1 12/2005 Below
2008/0034753 A1 * 2/2008 Furman ..... F04D 27/001 60/605.1
2009/0044542 A1 2/2009 Thatcher et al.
2009/0055071 A1 * 2/2009 Way ..... F02C 9/28 701/100
2010/0263391 A1 10/2010 Tetu et al.
2010/0296914 A1 * 11/2010 Staroselsky et al. ..... 415/47

FOREIGN PATENT DOCUMENTS

DE 102008044433 A1 2/2009
GB 1452771 A 10/1976
GB 2127899 A 4/1984
JP 03-213696 A 9/1991
JP 04-047197 A 2/1992
JP 07026639 B2 3/1995
JP 2002503787 A 2/2002
JP 2003214380 A 7/2003
JP 2009047167 A 3/2009
WO 97/38270 A1 10/1997
WO 99/42240 A1 8/1999
WO 2004/013494 A1 2/2004
WO 2009055878 A2 5/2009
WO 2009058975 A1 5/2009

OTHER PUBLICATIONS

Extended European Search Report for EP Application No. 16189374.8 dated Feb. 13, 2017, 6 pages.
Extended European Search Report for EP Application No. 16189373.0 dated Feb. 16, 2017, 7 pages.

* cited by examiner

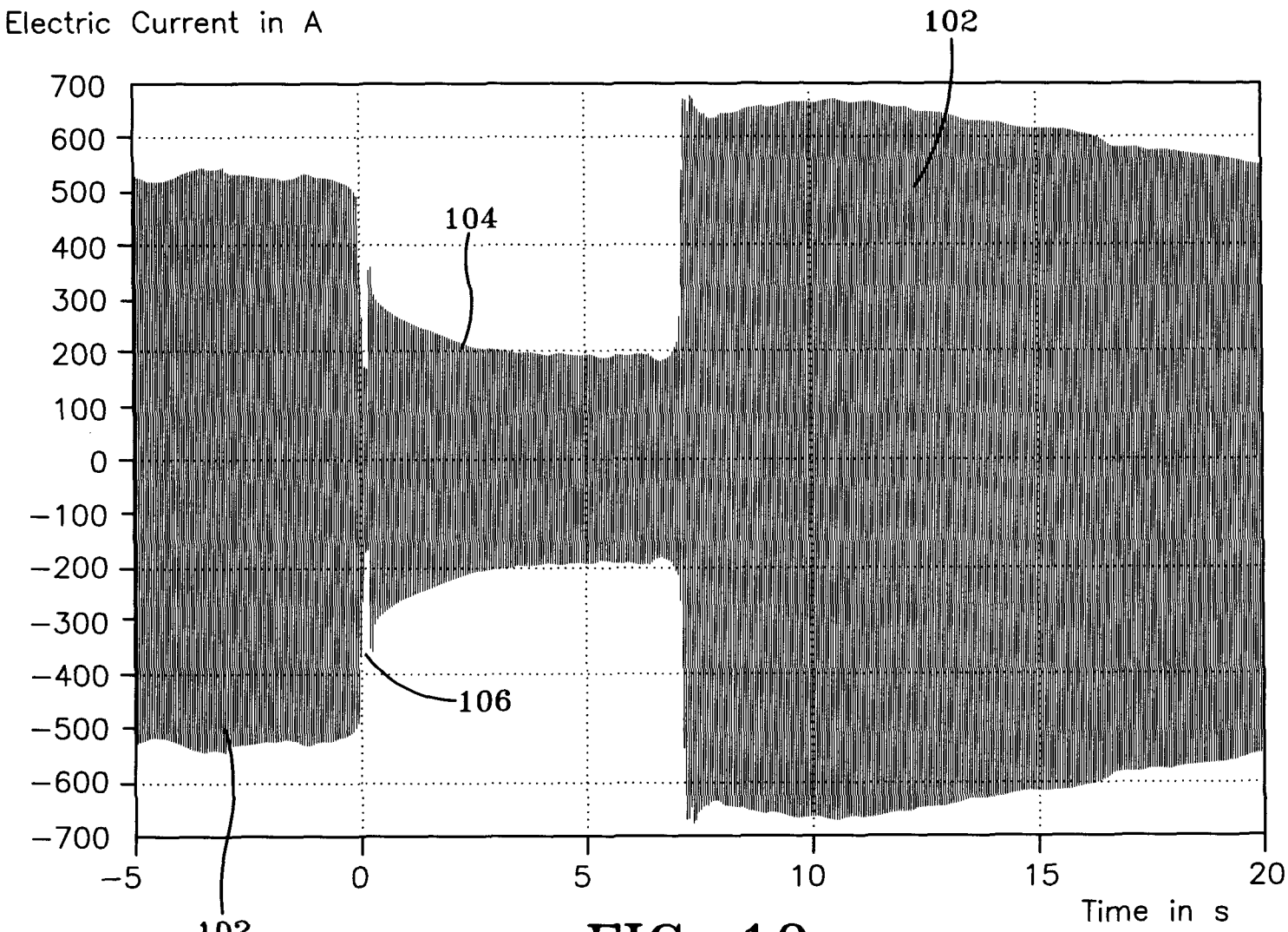
FIG−10

CONTROL SYSTEM FOR CENTRIFUGAL COMPRESSOR

CROSS-REFERENCE TO RELATED APPLICATIONS

This application claims priority from and the benefit of U.S. Provisional Application No. 61/184,551, entitled METHOD AND APPARATUS FOR SURGE DETECTION, filed Jun. 5, 2009, which is hereby incorporated by reference.

BACKGROUND

The application generally relates to a control system for a compressor. The application relates more specifically to a system and method to sense compressor instabilities and provide for remediation of the instabilities to return the compressor to stable operation.

A centrifugal compressor may encounter instabilities such as surge or stall during operation. Surge or surging is a transient phenomenon having oscillations in pressures and flow, and can result in complete flow reversal through the compressor. Surging, if uncontrolled, can cause excessive vibrations in both the rotating and stationary components of the compressor, and may result in permanent compressor damage. One technique to correct a surge condition can involve the opening of a hot gas bypass valve to return some of the discharge gas of the compressor to the compressor inlet to increase the flow at the compressor inlet. In contrast, stall or rotating stall is a local flow separation in one or more components of a compressor, and can have discharge pressure disturbances at fundamental frequencies less than the rotational frequency of the impeller of the compressor. Rotating stall in a fixed speed centrifugal compressor is predominantly located in the diffuser of the compressor and can be remediated with a variable geometry diffuser (VGD). The presence of rotating stall in the compressor can be a precursor of an impending surge condition.

A VGD for a centrifugal compressor can include a ring that can be moved in a diffuser gap, which is part of the discharge passage of the compressor. The VGD can move the ring between a retracted position, in which the ring is completely out of the diffuser gap to allow maximum gas flow, to an extended position, in which the ring occupies a portion of the diffuser gap, thereby restricting a portion of the gas flow. The ring can be moved in response to the detection of stall conditions in the centrifugal compressor to remediate the stall condition.

One method for detecting and controlling rotating stall in a diffuser region of a centrifugal compressor includes using a pressure transducer placed in the compressor discharge passageway or the diffuser to measure the prevalent sound or acoustic pressure. The signal from the pressure transducer is filtered and processed via analog or digital techniques to determine the presence or likelihood of rotating stall. Rotating stall is detected by comparing a calculated energy amount from measured discharge pressure pulses or pulsations with a predetermined threshold amount corresponding to the presence of rotating stall. The ring of the VGD may be inserted into the diffuser gap to reduce the pressure pulsation levels and remediate the stall condition.

However, for a portion of the operating range of a centrifugal compressor, the compressor can surge without the occurrence of a prior stall condition, especially when the compressor is operating at low speeds. When the compressor directly enters a surge condition, the control system for the compressor does not have an opportunity to sense for the precursor stall condition. Consequently, the control system of the compressor cannot initiate a corrective action for the stall condition to possibly avoid the onset of the surge condition. Other aspects of the control system for dealing with surge conditions in the compressor require that the control system identify a surge condition(s) and react in a predetermined sequence. For the control system to identify a surge condition, one or more surge cycles must occur during a predetermined length of time before the control system can take corrective action. Corrective steps may also require interaction with other system controls to maintain a required overall system operating condition.

Therefore, what is needed is a system and method for detecting surge conditions without having to determine the presence of a stall condition or wait through one or more surge cycles.

SUMMARY

The present invention is directed to a method of operating a centrifugal compressor. The method includes measuring an amplitude of a displacement of a shaft of the centrifugal compressor from a predetermined position and comparing the measured amplitude to a predetermined threshold amplitude. The predetermined threshold amplitude corresponds to an amplitude of the displacement of the shaft from the predetermined position during stable operation of the centrifugal compressor. The method also includes indicating a precursor of a surge condition in response to the measured amplitude being greater than the predetermined threshold amplitude and adjusting an operating parameter of the centrifugal compressor to remediate the surge condition in response to the precursor being indicated.

The present invention is also directed to a second method of operating a centrifugal compressor. The method includes measuring an electric current and comparing the measured electric current to a predetermined threshold electric current. The predetermined threshold electric current corresponds to an electric current occurring during stable operation of the centrifugal compressor. The method also includes indicating a precursor of a surge condition in response to the measured electric current being less than the predetermined threshold electric current and adjusting an operating parameter of the centrifugal compressor to remediate the surge condition in response to the precursor being indicated.

The present invention is further directed to a centrifugal compressor. The centrifugal compressor includes an impeller, a variable geometry diffuser in fluid communication with an output of the impeller and a motor connected to the impeller by a shaft. The centrifugal compressor also includes a sensor and a control panel to control operation of the motor and the variable geometry diffuser. The sensor is configured and positioned to measure an operational parameter related to one of electric current or shaft position. The control panel is configured to receive a signal from the sensor corresponding to the measured operational parameter and is configured to determine if a precursor to a surge condition is present based on the received signal from the sensor and to take remedial action in response to a precursor to a surge condition being present.

The present invention is directed to a third method of operating a centrifugal compressor. The method includes measuring an operational parameter for a centrifugal compressor and processing the measured operational parameter to remove any extraneous information. The operational parameter is selected from the group consisting of discharge pressure, compressor vibration and acoustic energy. The method also includes comparing the measured operational parameter to a predetermined value and indicating a precursor of a surge condition in response to the measured operational parameter being greater than the predetermined value. The predetermined value corresponds to a value of the operational parameter occurring during stable operation of the centrifugal compressor. The method further includes adjusting at least one of a position of a variable geometry diffuser of the centrifugal compressor or the speed of the centrifugal compressor to remediate the surge condition in response to the precursor being indicated.

BRIEF DESCRIPTION OF THE DRAWINGS

FIG. 10 shows an exemplary embodiment of motor current before, during and after a surge condition.

DETAILED DESCRIPTION OF THE EXEMPLARY EMBODIMENTS

Figure 1:
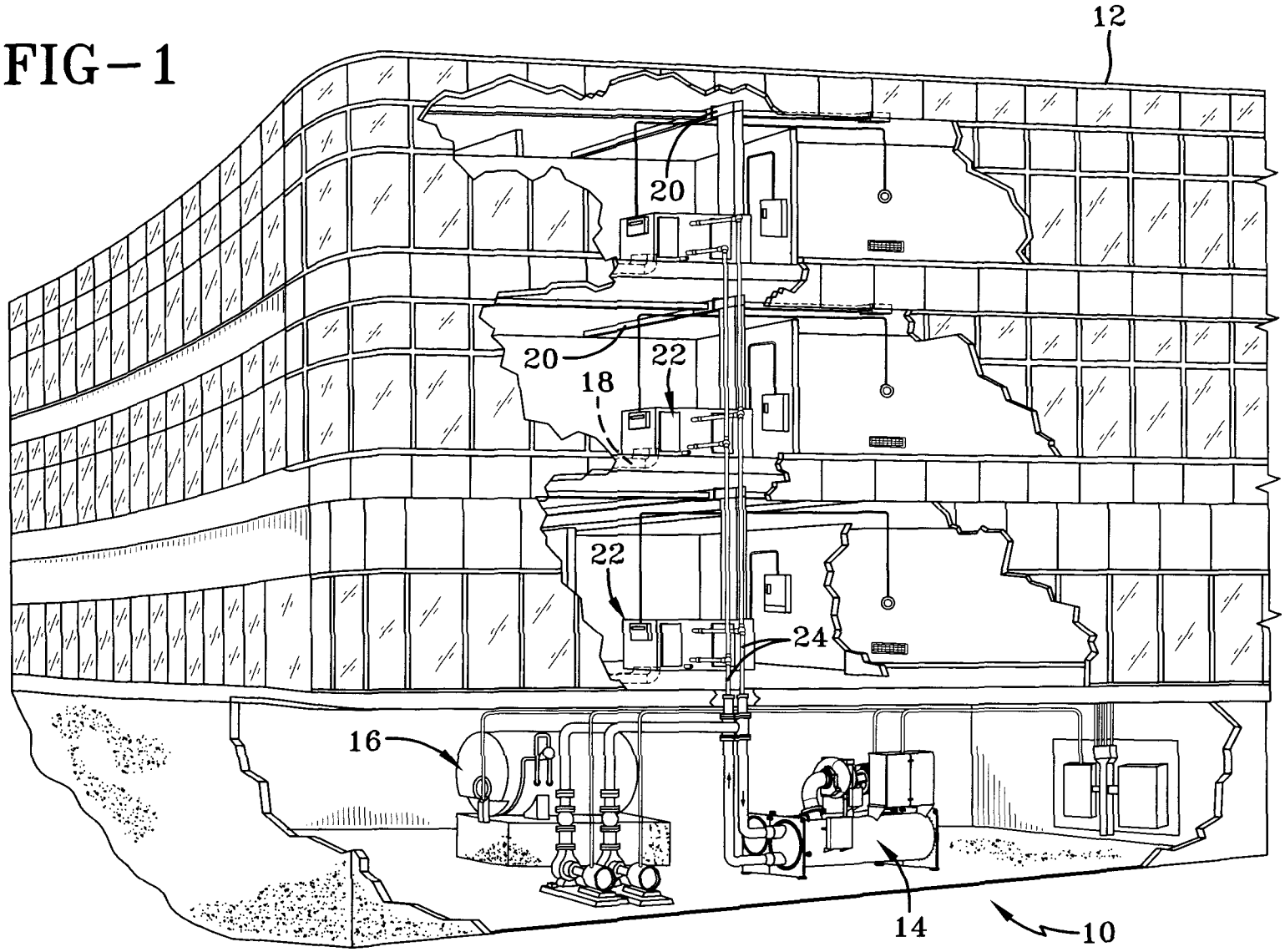
FIG. 1 shows an exemplary embodiment for a heating, ventilation and air conditioning system.

FIG. 1 shows an exemplary environment for a heating, ventilation and air conditioning (HVAC) system 10 in a building 12 for a typical commercial setting. System 10 can include a vapor compression system 14 that can supply a chilled liquid which may be used to cool building 12. System 10 can include a boiler 16 to supply a heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
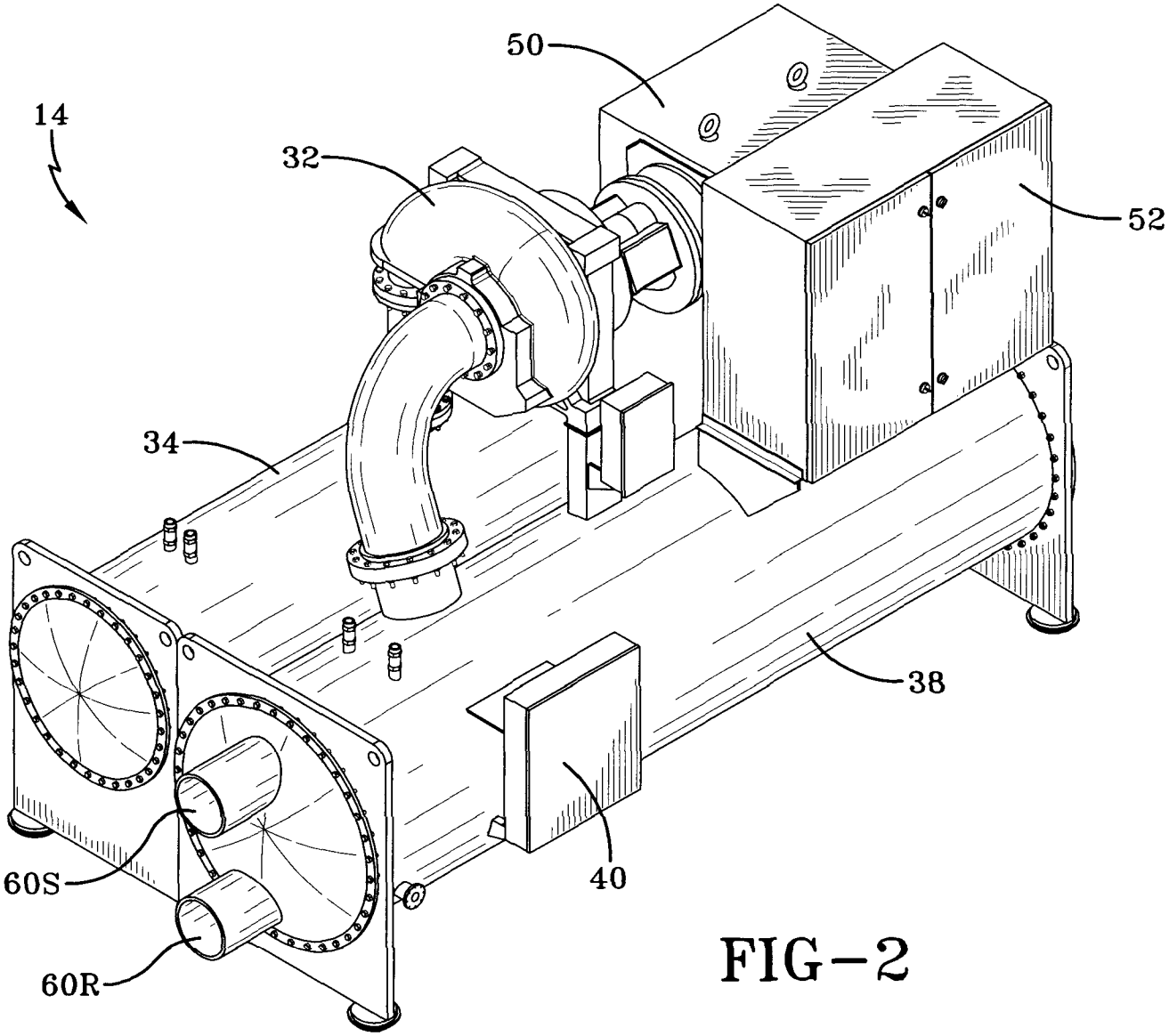
FIG. 2 shows an isometric view of an exemplary vapor compression system.
Figure 3:
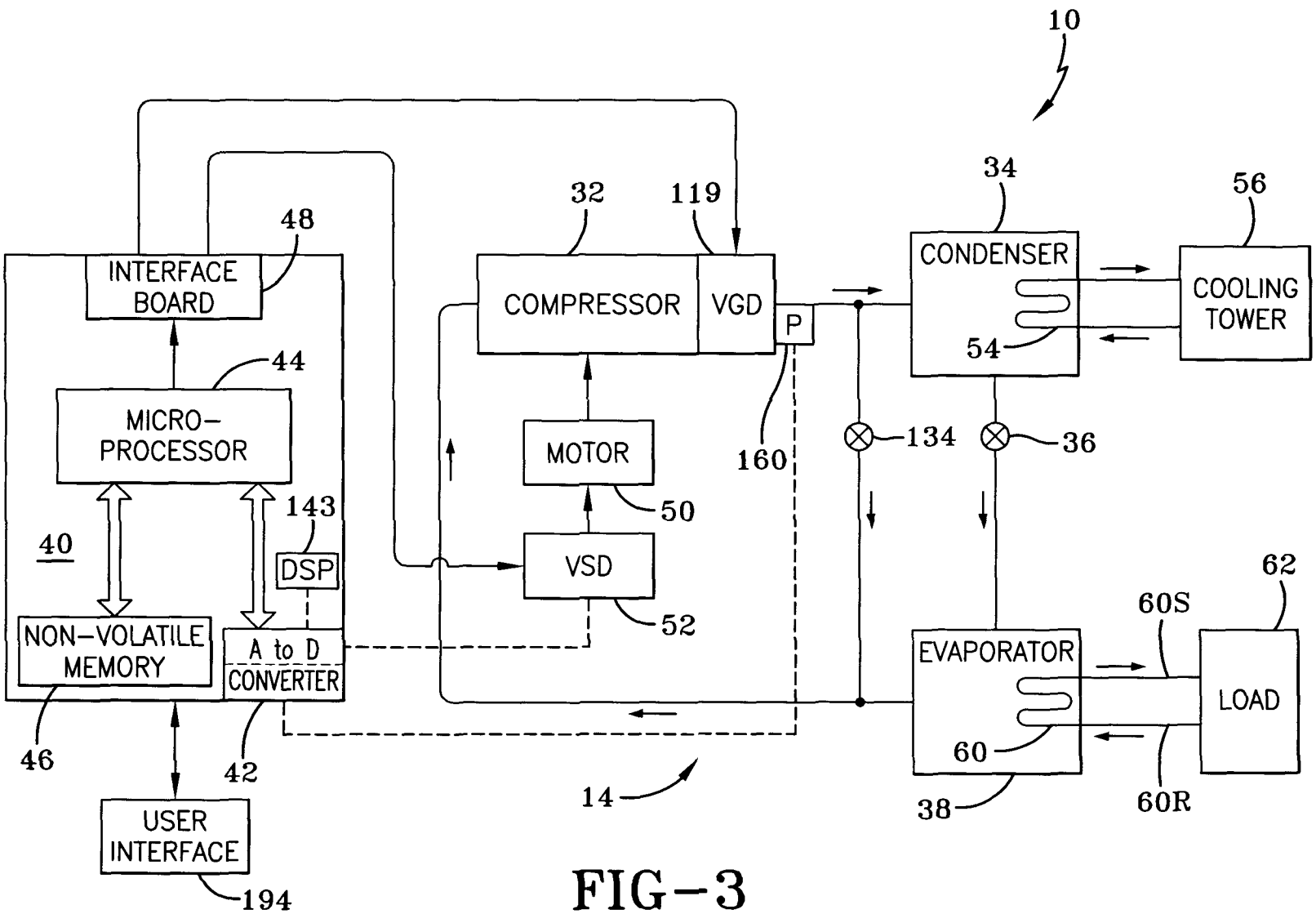
FIG. 3 shows schematically an exemplary embodiment for a heating, ventilation and air conditioning system.

FIGS. 2 and 3 show an exemplary vapor compression system 14 that can be used in HVAC system 10. Vapor compression system 14 can circulate a refrigerant through a circuit starting with compressor 32 and including a condenser 34, expansion valve(s) or device(s) 36, and an evaporator or liquid chiller 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant.

Motor 50 used with compressor 32 can be powered by a variable speed drive (VSD) 52 or can be powered directly from an alternating current (AC) or direct current (DC) power source. Motor 50 can include any type of electric motor that can be powered by a VSD or directly from an AC or DC power source. Motor 50 can be any suitable motor type, for example, a switched reluctance motor, an induction motor, or an electronically commutated permanent magnet motor. In an alternate exemplary embodiment, other drive mechanisms such as steam or gas turbines or engines and associated components can be used to drive compressor 32.

Figure 4:
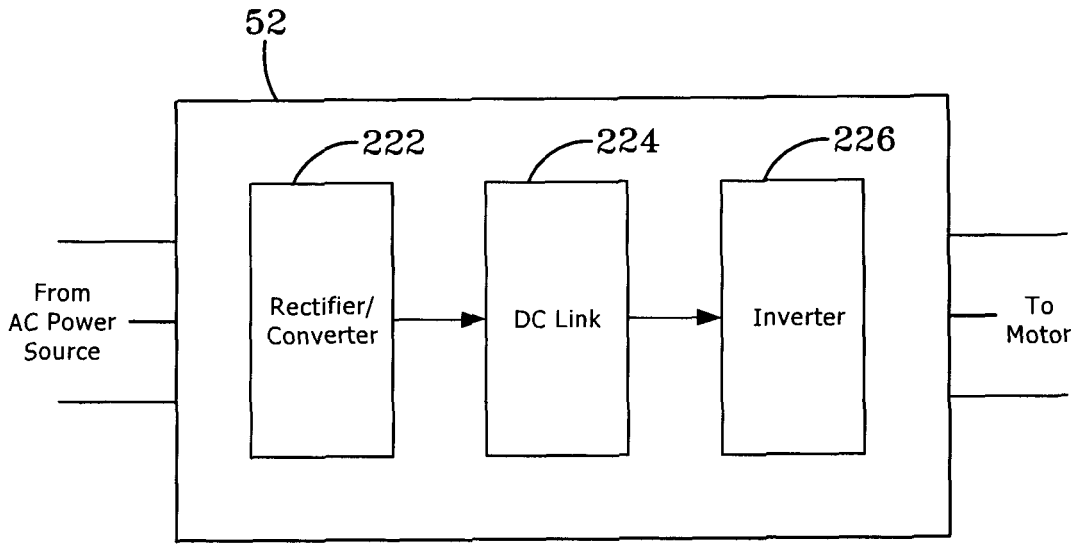
FIG. 4 shows schematically an exemplary embodiment of a variable speed drive.

FIG. 4 shows an exemplary embodiment of a VSD. VSD 52 receives AC power having a particular fixed line voltage and fixed line frequency from an AC power source and provides AC power to motor 50 at a desired voltage and desired frequency, both of which can be varied to satisfy particular requirements. VSD 52 can have three components: a rectifier/converter 222, a DC link 224 and an inverter 226. The rectifier/converter 222 converts the fixed frequency, fixed magnitude AC voltage from the AC power source into DC voltage. The DC link 224 filters the DC power from the converter 222 and provides energy storage components such as capacitors and/or inductors. Finally, inverter 226 converts the DC voltage from DC link 224 into variable frequency, variable magnitude AC voltage for motor 50.

In an exemplary embodiment, the rectifier/converter 222 may be a three-phase pulse width modulated boost rectifier having insulated gate bipolar transistors to provide a boosted DC voltage to the DC link 224 to obtain a maximum RMS output voltage from VSD 52 greater than the input voltage to VSD 52. Alternately, the converter 222 may be a passive diode or thyristor rectifier without voltage-boosting capability.

VSD 52 can provide a variable magnitude output voltage and variable frequency to motor 50, to permit effective operation of motor 50 in response to a particular load conditions. Control panel 40 can provide control signals to VSD 52 to operate the VSD 52 and motor 50 at appropriate operational settings for the particular sensor readings received by control panel 40. For example, control panel 40 can provide control signals to VSD 52 to adjust the output voltage and output frequency provided by VSD 52 in response to changing conditions in vapor compression system 14, i.e., control panel 40 can provide instructions to increase or decrease the output voltage and output frequency provided by VSD 52 in response to increasing or decreasing load conditions on compressor 32.

Compressor 32 compresses a refrigerant vapor and delivers the vapor to condenser 34 through a discharge passage. In one exemplary embodiment, compressor 32 can be a centrifugal compressor having one or more compression stages. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. A hot gas bypass valve (HGBV) 134 may be connected in a separate line extending from compressor discharge to compressor suction. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle 60 having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 lowers the temperature of the process fluid in the tubes. The tube bundle 60 in evaporator 38 can include a plurality of tubes and a plurality of tube bundles. The vapor refrigerant exits evaporator 38 and returns to compressor 32 by a suction line to complete the circuit or cycle. In an exemplary embodiment, vapor compression system 14 may use one or more of each of variable speed drive (VSD) 52, motor 50, compressor 32, condenser 34, expansion valve 36 and/or evaporator 38 in one or more refrigerant circuits.

Figure 5:
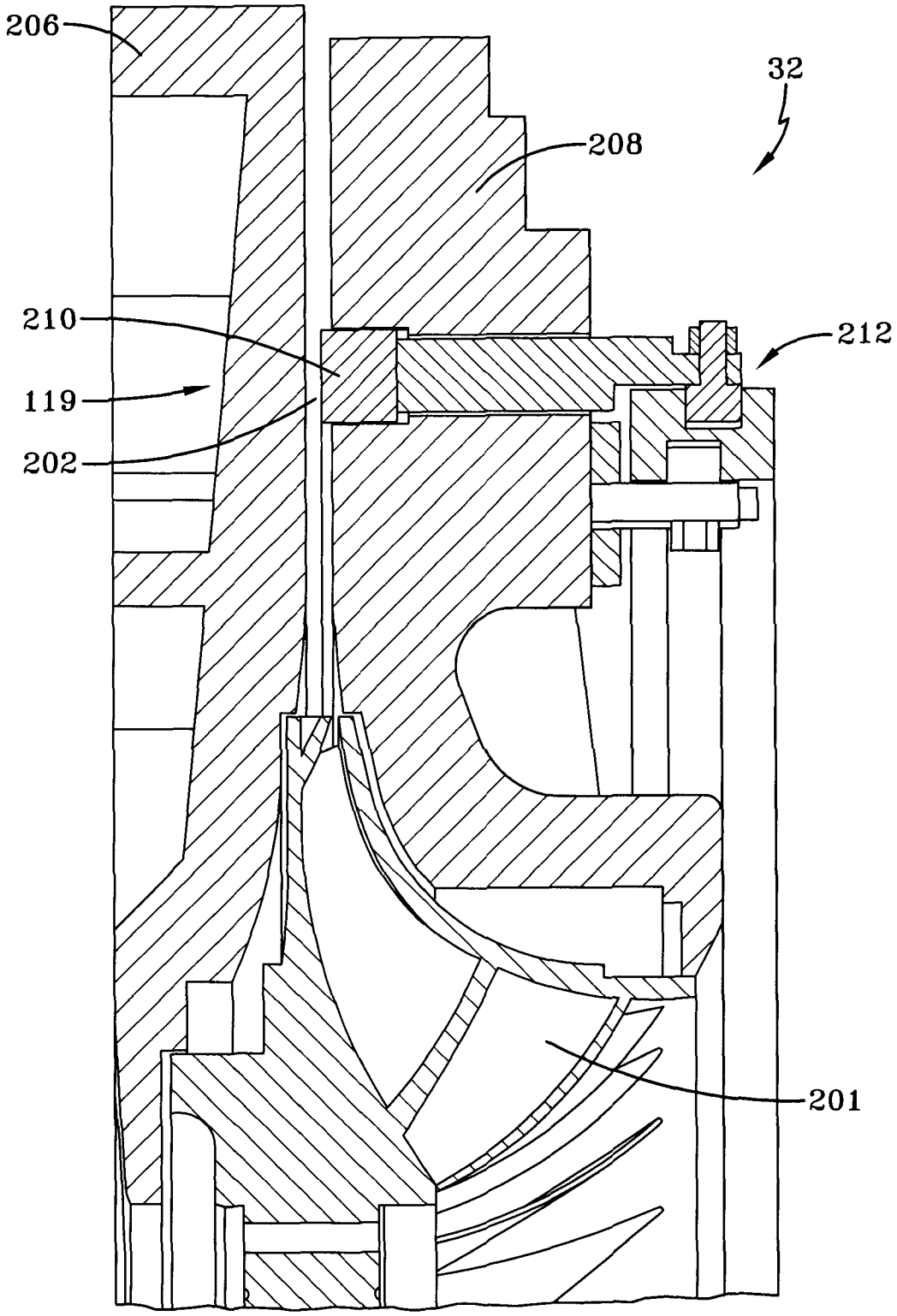
FIG. 5 shows a partial cross-sectional view of an exemplary embodiment of a variable geometry diffuser in a compressor.

FIG. 5 illustrates a partial cross-sectional view of an exemplary embodiment of compressor 32. Compressor 32 includes an impeller 201 for compressing the refrigerant vapor. The compressed vapor from impeller 201 then passes through a diffuser or VGD 119. VGD 119 has a diffuser space or gap 202 formed between a diffuser plate 206 and a nozzle base plate 208 for the passage of the refrigerant vapor. Nozzle base plate 208 is configured for use with a diffuser ring 210. Diffuser ring 210 is used to control the velocity of refrigerant vapor that passes through diffuser space or gap 202. Diffuser ring 210 can be extended into diffuser gap 202 to increase the velocity of the vapor flowing through diffuser gap 202 and can be retracted from diffuser gap 202 to decrease the velocity of the vapor flowing through diffuser gap 202. Diffuser ring 210 can be extended into and retracted from diffuser gap 202 using an adjustment mechanism 212, driven by an actuator.

VGD 119 can be positionable to any position between a substantially open or retracted position, wherein refrigerant flow is substantially unimpeded in diffuser gap 202, and a substantially closed or extended position, wherein refrigerant flow in diffuser gap 202 is restricted. In one exemplary embodiment, VGD 119, when in the closed position, may not completely stop the flow of refrigerant in diffuser gap 202. Adjustment mechanism 212 can move the diffuser ring 210 either continuously, or incrementally in discrete steps to open and close the diffuser gap 202. A more detailed description of the operation and components of one type of VGD is provided in U.S. Pat. No. 6,872,050 issued Mar. 29, 2005, entitled "Variable Geometry Diffuser Mechanism", which patent is hereby incorporated by reference.

In one exemplary embodiment, if compressor 32 has more than one compression stage, VGD 119 may be incorporated in the discharge passage of one or more of the compression stages. In another exemplary embodiment, more than one VGD 119 may be positioned in diffuser gap 202 to control the flow of refrigerant from the impeller 201, and thereby control the capacity of compressor 32.

In a further exemplary embodiment, the positioning of diffuser ring 210 can decrease or eliminate surge conditions and stall conditions in compressor 32, and improve the operating efficiency of compressor 32 when operating at partial load conditions. In one exemplary embodiment, using VGD 119 in combination with VSD 52 for capacity control can improve the efficiency of compressor 32 at partial loads.

Control panel 40 can include a digital to analog (D/A) converter in addition to A/D converter 42. Further, control panel 40 can be connected to or incorporate a user interface 194 that permits an operator to interact with control panel 40. The operator can select and enter commands for control panel 40 through user interface 194. In addition, user interface 194 can display messages and information from control panel 40 regarding the operational status of vapor compression system 14. The user interface 194 can be located locally to control panel 40, such as being mounted on vapor compression system 14 or control panel 40, or alternatively, user interface 194 can be located remotely from control panel 40, such as being located in a separate control room apart from vapor compression system 14.

In control panel 40, A/D converter 42 and/or interface board 48 may receive input signals from system sensors and components that provide operational parameters for vapor compression system 14. For example, the input signals received by control panel 40 can include the temperature of the leaving chilled liquid temperature from tube bundle 60, refrigerant pressures in evaporator 38 and condenser 34, a compressor discharge temperature sensor, a compressor oil temperature sensor, a compressor oil supply pressure sensor, a VGD position sensor and an acoustic or sound pressure measurement in the compressor discharge passage. Control panel 40 can use interface board 48 to transmit signals to components of the vapor compression system 14 to control the operation of vapor compression system 14 and to communicate with various sensors and control devices of vapor compression system 14.

Control panel 40 may execute or use a single or central control algorithm or control system to control the operation of vapor compression system 14 including compressor 32, VSD 52, condenser 34 and the other components of vapor compression system 14. In one embodiment, the control algorithm(s) can be computer programs or software stored in non-volatile memory 46 having a series of instructions executable by microprocessor 44. While the control algorithm can be embodied in a computer program(s) and executed by microprocessor 44, it will be understood by those skilled in the art that the control algorithm may be implemented and executed using digital and/or analog hardware. If hardware is used to execute the control algorithm, the corresponding configuration of control panel 40 can be changed to incorporate the necessary components and to remove any components that may no longer be required. In still another embodiment, control panel 40 may incorporate multiple controllers, each performing a discrete function, with a central controller that determines the outputs of control panel 40.

In one exemplary embodiment, the control algorithm(s) can determine when to extend and retract diffuser ring 210 in VGD 119 in response to particular compressor conditions in order to maintain system and compressor stability (stable operation of the compressor), which, for the purpose of this application, is the absence of stall and surge conditions. Additionally, control panel 40 can use the control algorithm(s) to adjust or control the speed of the compressor by controlling or adjusting the speed of the motor with the variable speed drive in response to particular compressor conditions in order to maintain system and compressor stability. Further, control panel 40 can use the control algorithm(s) to open and close HGBV 134, if present, in response to particular compressor conditions in order to maintain system and compressor stability.

The central control algorithm executed by microprocessor 44 on the control panel 40 can include a capacity control program or algorithm to control the speed of motor 50 via VSD 52, and thereby the speed of compressor 32, to generate the desired capacity from compressor 32 to satisfy a cooling load. In one exemplary embodiment, the capacity control program can automatically determine a desired speed for motor 50 and compressor 32 in response to the leaving chilled liquid temperature in evaporator 38, which temperature is an indicator of the cooling load demand on vapor compression system 14. After determining the desired speed, control panel 40 sends or transmits control signals to VSD 52, thereby regulating the speed of motor 50.

The capacity control program can be configured to maintain selected parameters of vapor compression system 14 within preselected ranges. The selected parameters include motor speed, leaving chilled liquid temperature, motor power output, and anti-surge limits for minimum compressor speed and variable geometry diffuser position. The capacity control program may employ continuous feedback from sensors monitoring various operational parameters to continuously monitor and change the speed of motor 50 and compressor 32 in response to changes in system cooling loads. In other words, as vapor compression system 14 requires either additional or reduced cooling capacity, the operating parameters of compressor 32 in vapor compression system 14 are correspondingly updated or revised in response to the new cooling capacity requirement. To maintain maximum operating efficiency, the operating speed of compressor 32 can be frequently changed or adjusted by the capacity control algorithm. Furthermore, separate from system load requirements, the capacity control program may also continuously monitor the refrigerant system pressure differential to optimize the volumetric flow rate of refrigerant in vapor compression system 14 and to maximize the resultant efficiency of compressor 32.

The central control algorithm executed by microprocessor 44 on the control panel 40 can include various methods or techniques to identify the occurrence of or a precursor to a surge condition or cycle. Many of the various methods and techniques to identify the occurrence of or a precursor to a surge condition or cycle use existing sensors or components in vapor compression system 14 and do not require the installation of additional sensors or components.

In one exemplary embodiment, a pressure transducer or sensor 160 (see FIG. 3) may be placed in the discharge passage for compressor 32. Pressure transducer or sensor 160 may be used to directly sense a discharge pressure and generate a discharge pressure signal ($P_D$). The discharge pressure signal ($P_D$) can be used by the control system for numerous purposes such as the detection of stall conditions, capacity control, and effective compressor operation. In addition, the change in the value of $P_D$ may indicate that a surge condition is starting or is in progress. In an alternate embodiment, the discharge pressure signal ($P_D$) may be filtered and then analyzed for indications of a surge condition, such as by the process shown in FIG. 6.

Figure 6:
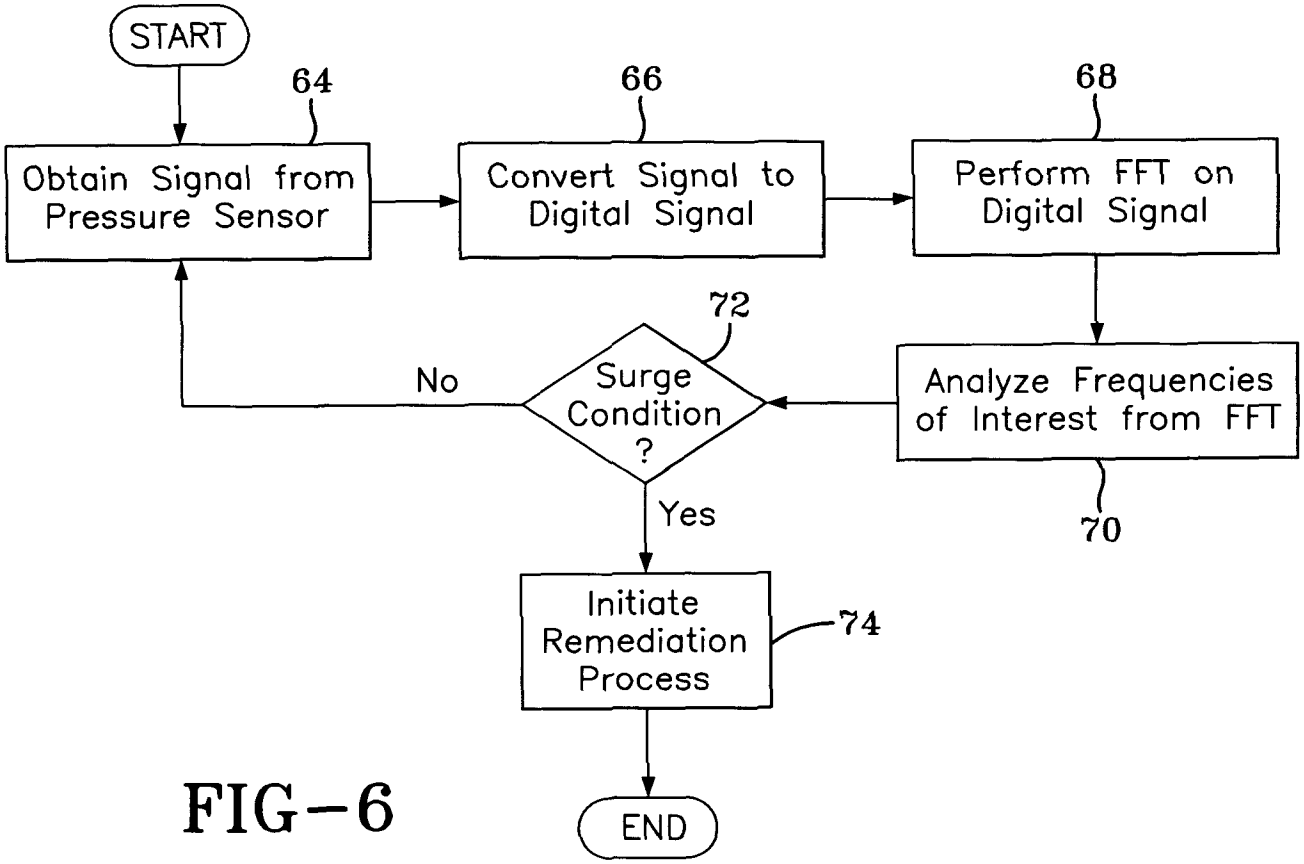
FIG. 6 shows an exemplary process for determining a surge condition.

In FIG. 6, a process is shown for analyzing the signal $P_D$ to determine the onset or occurrence of a surge condition. The process begins with control panel 40 receiving an analog signal from sensor 160 (step 64) and converting the received signal to a digital signal (step 66) with A/D converter 42. In an alternate embodiment, control panel 40 can receive a digital signal from sensor 160 and thus, would not have to convert the signal before continuing with the process. The digital signal corresponding to $P_D$ is then processed by a fast Fourier transform (FFT) (step 68) programmed into a Digital Signal Processing (DSP) chip 143 (see FIG. 3) on the control panel 40. In one exemplary embodiment, DSP 143 can be configured to perform any necessary operations or calculations, such as multiplies and accumulations, to execute the FFT in real time.

The application of the FFT to the digitized input signal from sensor 160 generates a plurality of frequencies and corresponding amplitudes, which amplitudes can be related to energy values. Since only a particular or predetermined range of fundamental frequencies may be required for the detection of surge conditions, only the frequencies in the predetermined range of fundamental frequencies have to be analyzed. The frequencies outside of the predetermined range or the frequencies within the predetermined range but not associated with surge conditions can be discarded or ignored. For example, frequencies associated with the operating speed of compressor 32, along with associated harmonics, can be removed or set to zero. Similarly, frequencies associated with electrical power, e.g., 60 Hz, along with associated harmonics, can be removed or set to zero. In one exemplary embodiment, a band pass filter may be applied to the output from the FFT to isolate the frequencies of interest. In another embodiment, a bandpass filter may be applied to the signal $P_D$ before the execution of the FFT, to permit only certain frequencies of interest to be analyzed.

After the elimination of extraneous frequencies and frequencies that are not of interest, the remaining components or frequencies from the FFT are analyzed (step 70). The results of the analysis can be used to determine if a surge condition or a precursor to a surge condition is present (step 72). If a surge condition or a precursor is determined to be present, the control system can initiate a remediation process or action (step 74) and the process ends. However, if a surge condition is not determined to be present, the process the returns to the start of the process for the measurement of pressure values with sensor 160.

In one exemplary embodiment, the detection of surge conditions or the precursor to a surge condition can be based on combining or summing the amplitudes of the frequencies of interest and then comparing the summed or resulting value with a threshold value that defines the surge condition or precursor. If the resulting value is greater than the threshold value, than a surge condition or precursor is determined to present. The threshold value can be set to a value equal to a multiple of the normal operating value for the summed or resulting value from the FFT components, i.e. the value of the summed or resulting value from the FFT components when there is no surge condition. The values for normal operation and the threshold value are dependent on the strength of the signal that is analyzed and on the amount of amplification that is applied to the signal to enhance signal to noise ratios. In another embodiment, surge conditions or precursors can be detected by determining if peaks in the remaining frequency spectrum exceed a pre-determined threshold value.

Figure 7:
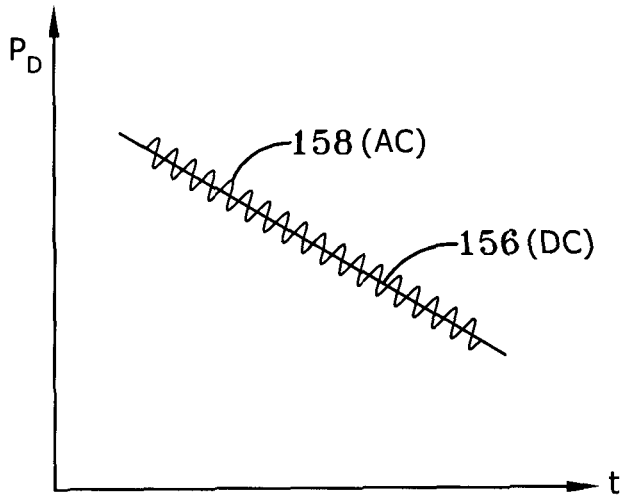
FIG. 7 shows an exemplary decaying discharge pressure signal over time.

In another exemplary embodiment to determine surge, the signal $P_D$ from sensor 160 may be analyzed for a decreasing level of the DC component. As shown in FIG. 7, the signal $P_D$ from sensor 160 has a DC component 156 with a superimposed AC component 158. To obtain DC component 156, the AC component or ripple 158 can be filtered from the signal $P_D$. The control system then calculates an RMS value of the DC component of the signal $P_D$. To determine a surge condition, the RMS value of the DC component of the signal is compared sequentially to the previous RMS value to determine whether the mean level is decaying or decreasing. If a surge condition is indicated, VGD 119 and/or compressor speed is adjusted as discussed above until stability returns to the system.

Figure 8:
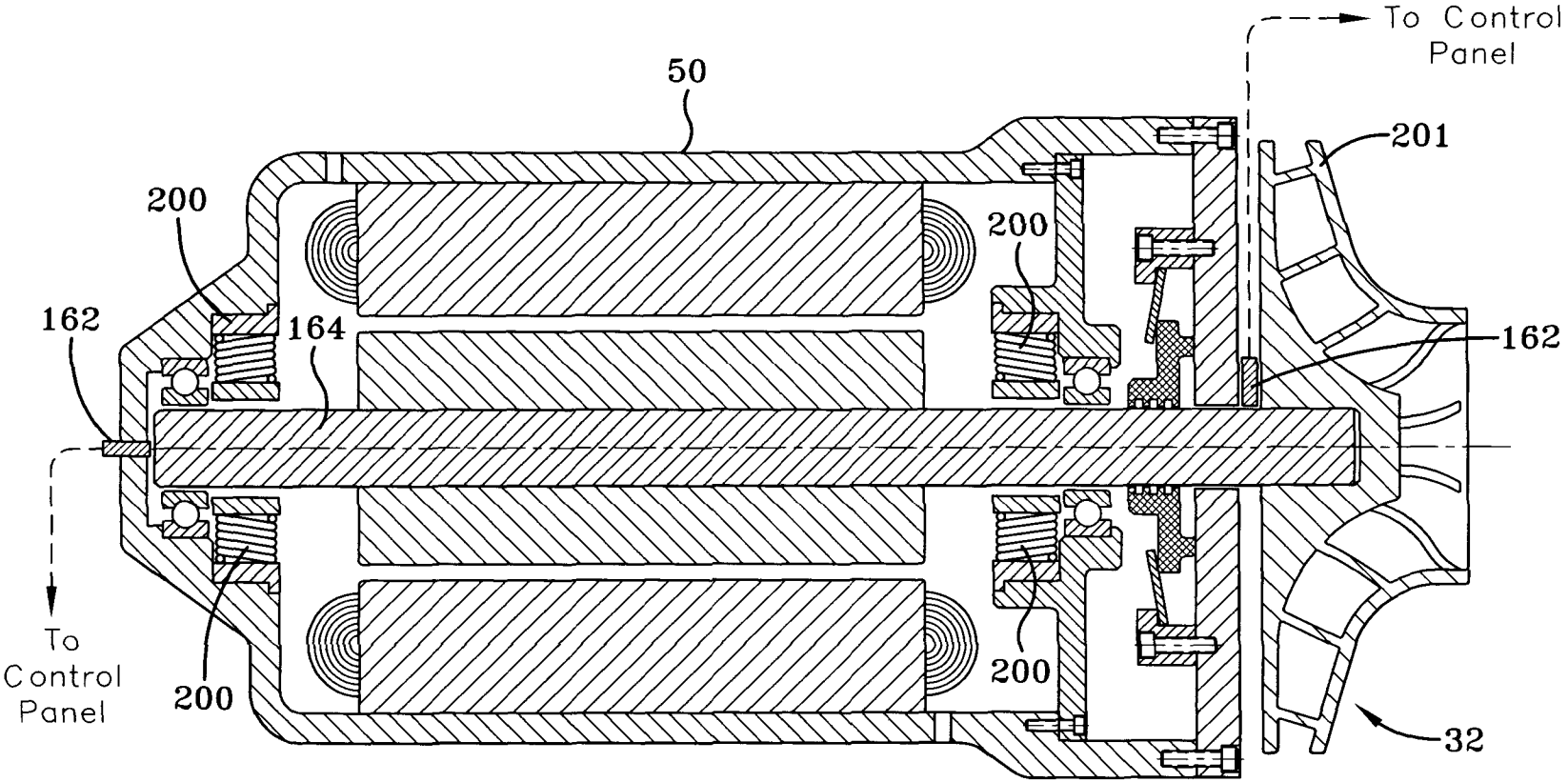
FIG. 8 shows a cross-sectional view of an exemplary embodiment of a motor and compressor impeller.

In still another exemplary embodiment, the precursor to or presence of a surge condition can be determined by measuring the amplitude of the axial and or radial displacement or perturbation of the shaft for the compressor and motor. FIG. 8 shows a cross-sectional view of motor 50 and impeller 201 of compressor 32 in one exemplary embodiment. Motor 50 can include two or more electromagnetic bearings 200. Electromagnetic bearings 200 can be located at each end of motor 50 and can be used to levitate the rotor or shaft 164 of motor 50 instead of conventional technologies like rolling element bearings or fluid film bearings. Electromagnetic bearings 200 can monitor the position of shaft 164 and provide the position information to control panel 40. Control panel 40 can then adjust the electric current supplied to electromagnetic bearings 200 to maintain the center of shaft 164 at a desired position or within a desired tolerance range. The desired position for the center of shaft 164 can be substantially coaxial with the electromagnetic bearing axis, or within an allowable tolerance. As used herein, the normal operation of shaft 164 is also referred to as the centered position, meaning that the shaft axis coincides (or lies within an acceptable tolerance) of the bearing axis.

Figure 9:
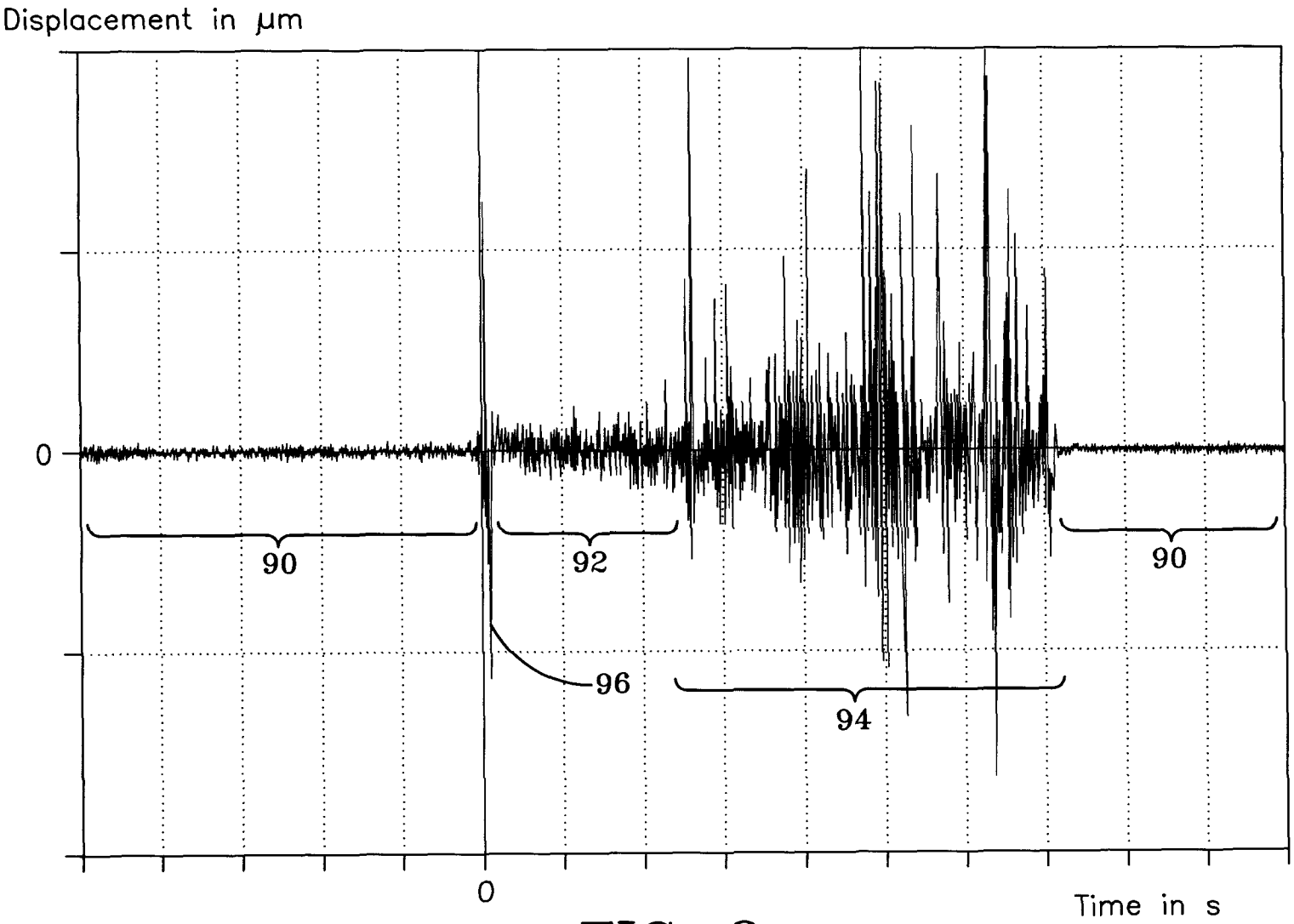
FIG. 9 shows an exemplary embodiment of axial shaft displacement before, during and after a surge condition.

Unstable periodic orbits, deviations or perturbations of compressor shaft position, either axial or radial, in electromagnetic bearings 200 may be used to determine the onset or occurrence of a surge condition. FIG. 9 shows the amplitudes of axial displacement (in micrometers, μm) of shaft 164 from the centered position for a surge cycle, i.e., stable compressor operation through a surge condition and back to stable compressor operation. In FIG. 9, stable compressor operation occurs at area 90, the surge condition occurs at area 92, the recovery from the surge condition occurs at area 94, and a precursor of the surge condition occurs at area 96. In one exemplary embodiment, the precursor of the surge condition corresponds to a reversal of flow in the compressor, the surge condition corresponds to free spinning of the impeller with no compression and flow in the reverse direction, and recovery from the surge condition corresponds to the impeller starting to load again to develop pressure rise and flow in the positive direction.

The control system can analyze the compressor shaft position provided by electromagnetic bearings 200 to identify the precursor of the surge condition and can take actions to remediate the surge condition, e.g., by adjusting VGD 119 or increasing the speed of compressor 32. The control system can identify the precursor of the surge condition by determining when the measured axial shaft displacement amplitude is greater than the axial shaft displacement amplitude under stable compressor operation.

In one exemplary embodiment, the measured axial shaft displacement amplitude can be a predetermined amount greater than the axial shaft displacement amplitude under normal operation to indicate the precursor to a surge condition. For example, a precursor to a surge condition can be indicated when the measured axial shaft displacement amplitude is greater than or equal to 20 μm more than the axial shaft displacement amplitude under normal operation. In another exemplary embodiment, the measured axial shaft displacement amplitude can be several times or orders of magnitude greater than the axial shaft displacement amplitude under normal operation to indicate the precursor to a surge condition. For example, a precursor to a surge condition can be indicated when the measured axial shaft displacement amplitude is between about 4 to about 25 times greater than the axial shaft displacement amplitude under normal operation. In another exemplary embodiment, an analysis of radial shaft displacement amplitude can be performed to determine a precursor to a surge condition similar to the axial shaft displacement amplitude analysis.

In still another exemplary embodiment, the axial and radial shaft displacement amplitude measurements can be obtained from position-sensing probes 162 (see FIG. 8) located by compressor shaft 164 instead of from magnetic bearings 200. The position-sensing probes 162 can provide the displacement amplitude measurements to control panel 40, which can then analyze the measurements in the same manner as the electromagnetic bearing displacement amplitude measurements.

In a further exemplary embodiment, the measured current in electromagnetic bearings 200 may also be used to detect stall or impending surge conditions. An increase in current through the electromagnetic bearing 200 can indicate the presence of stall or surge conditions if the current level exceeds a predetermined threshold.

In another exemplary embodiment, surge conditions may be detected by monitoring motor current or DC link current in VSD 52 for indications of a surge condition. The motor current of DC link current can be measured and/or monitored by any suitable device and provided to control panel 40. FIG. 10 shows motor current (in amperes, A) for a surge cycle, i.e., stable compressor operation through a surge condition and back to stable operation. In FIG. 10, stable compressor operation occurs at area 102, the surge condition and recovery occurs at area 104, and a precursor of the surge condition occurs at area 106.

The control system can analyze the motor current to identify the precursor of the surge condition and can take actions to remediate the surge condition, e.g., by adjusting VGD 119. The control system can identify the precursor of the surge condition by determining when the measured motor current is less than the motor current under stable compressor operation. In one exemplary embodiment, the measured motor current can be a predetermined amount less than the motor current under normal operation to indicate the precursor to a surge condition. For example, a precursor to a surge condition can be indicated when the measured motor current is between about 150 A to about 350 A less than the motor current under normal operation. The specific amount of reduction in motor current necessary to indicate a precursor to a surge condition can vary based on several factors such as motor horsepower and motor voltage. In another exemplary embodiment, the measured motor current can be a reduced percentage of the motor current under normal operation to indicate the precursor to a surge condition. For example, a precursor to a surge condition can be indicated when the measured motor current is between about 25% to about 60% of the motor current under normal operation.

Figure 11:
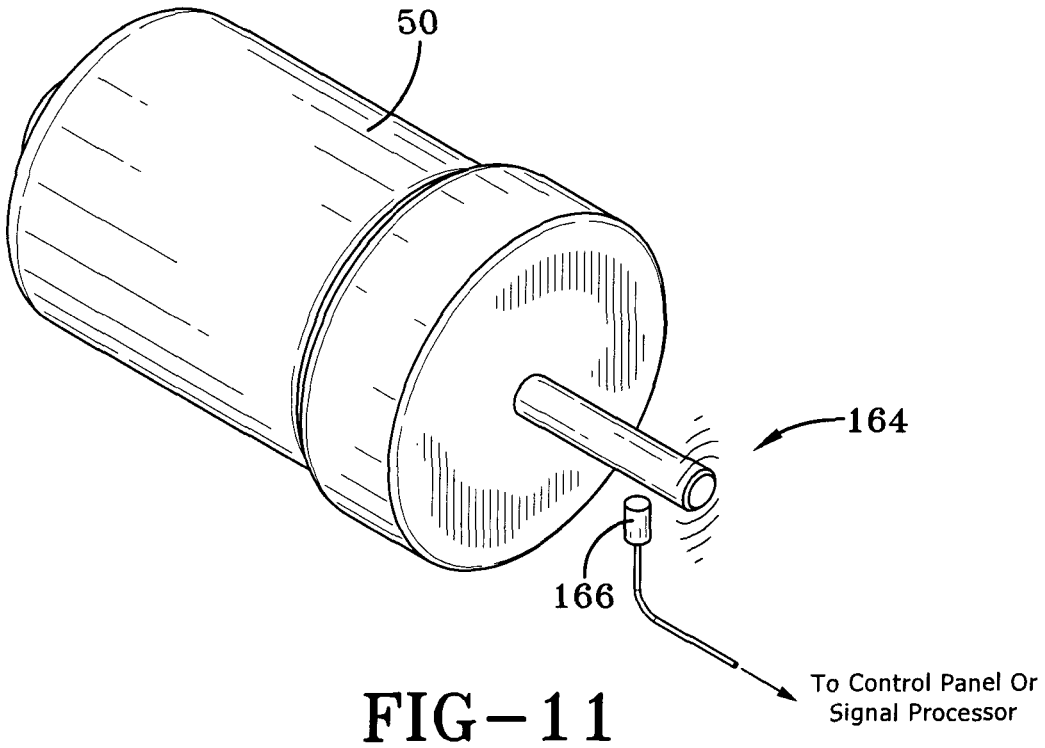
FIG. 11 shows schematically an exemplary embodiment of a microphone or acoustic sensor positioned near a compressor shaft.

Referring next to FIG. 11, acoustical sensing may be implemented using a microphone or acoustic sensor 166. Microphone 166 may optionally include a tuned filter to attenuate acoustical frequencies other than the frequencies of interest (the frequencies that accompany a surge condition in the compressor). In another exemplary embodiment, an accelerometer (a device that measures accelerations) configured to measure stall or surge related vibrations or single- and multi-axis vibration transducers or sensors can be used to sense vibration and shocks of the compressor. Vibration of the compressor, including the shaft, generates airborne sound that can be detected by microphone 166 and used to determine rotating stall or an impending surge condition.

The output of microphone 166 and/or accelerometer and/or vibration sensor may be conditioned so as to differentiate between surge-related acoustic energy and energy due to other sources of sound or vibration. In one embodiment, the conditioning can occur by simply measuring the amount of energy within a range of frequencies that includes the fundamental surge frequency and its major harmonics. In other conditioning schemes, some frequencies within the surge-related region that are not related to surge could be sensed and removed from the analysis in order to enhance the ability to detect the presence of only surge condition energies. The conditioned output signal from microphone 166 and/or accelerometer and/or vibration sensor can be linear summed to a predetermined frequency, e.g., about 1 kHz, and compared to a threshold value. If the condition output signal is greater than the threshold amount by a predetermined value, e.g., 10 decibels, dB, then a precursor to a surge condition is detected and corrective action to avoid stall or impending surge conditions can be taken.

In another exemplary embodiment, an increase in the fluid temperature at the inlet of the compressor near the impeller can be used to determine a precursor to a surge condition because the back flow of warm condenser vapor through the impeller during a surge condition causes the temperature at the inlet of the compressor to increase. A dynamic temperature sensor (not shown) may be used with dynamic response times to measure the fluid temperature entering the compressor.

The surge and precursor detection techniques discussed in the application can apply to a single stage centrifugal compressor or a multi-stage centrifugal compressor. For a multi-stage centrifugal compressor, the surge and precursor detection techniques discussed in the application can be applied to one or more of the first stage, last stage or intermediate stages.

To remediate a detected surge condition or precursor, the control panel and control system can insert the diffuser ring into the diffuser gap of the centrifugal compressor. Alternatively or n addition to, the control panel and control system can substantially increase the speed of the centrifugal compressor, e.g., by 3 Hz, 5 Hz or 7 Hz, with the variable speed drive to remediate a detected surge condition or precursor.

One exemplary embodiment relates to the use of the pressure transducer in the compressor discharge for stall detection to also sense the changes of pressure over time that are associated with a surge condition. By properly processing the pressure transducer signal, a single surge occurrence or cycle can be identified and the control system may react by extending the VGD into the diffuser gap to remediate against further surge cycles at the given operating conditions of the compressor.

Still another exemplary embodiment relates to a stability control system for maintaining stable operation of a centrifugal compressor having a compressor inlet, a compressor outlet and a variable geometry diffuser with an adjustable flow passage. The stability control system has a surge reacting state to adjust a flow passage of a variable geometry diffuser in response to detecting a surge condition or precursor in the centrifugal compressor. One method of sensing and detecting surge conditions can use a pressure transducer located in the compressor discharge line to communicate a discharge pressure ($P_D$) signal to a control panel. Other methods of sensing and detecting a surge condition or precursor can use: measurements of axial and radial shaft movements of a compressor shaft; the electrical current used by electromagnetic bearings in the compressor; the electric current through the compressor drive motor or at the DC link of a VSD; the sound generation (acoustical pressures or waves) from the compressor or motor; or compressor vibrations.

It should be understood that the application is not limited to the details or methodology set forth in the following description or illustrated in the figures. It should also be understood that the phraseology and terminology employed herein is for the purpose of description only and should not be regarded as limiting.

The present application contemplates methods, systems and program products on any machine-readable media for accomplishing its operations. The embodiments of the present application may be implemented using existing computer processors, or by a special purpose computer processor for an appropriate system, or by a hardwired system.

Embodiments within the scope of the present application include program products comprising machine-readable media for carrying or having machine-executable instructions or data structures stored thereon. Machine-readable media can be any available non-transitory media that can be accessed by a general purpose or special purpose computer or other machine with a processor. By way of example, machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Although the figures herein may show a specific order of method steps, the order of the steps may differ from what is depicted. Also, two or more steps may be performed concurrently or with partial concurrence. Variations in step performance can depend on the software and hardware systems chosen and on designer choice. All such variations are within the scope of the application. Likewise, software implementations could be accomplished with standard programming techniques with rule based logic and other logic to accomplish the various connection steps, processing steps, comparison steps and decision steps.

It is important to note that the construction and arrangement of the present application as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter described in the application. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application. Accordingly, the present application is not limited to a particular embodiment, but extends to various modifications that nevertheless fall within the scope of the appended claims.

Furthermore, in an effort to provide a concise description of the exemplary embodiments, all features of an actual implementation may not have been described (i.e., those unrelated to the presently contemplated best mode of carrying out the invention, or those unrelated to enabling the invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A method of operating a centrifugal compressor, comprising:

operating a motor of the centrifugal compressor to rotate a motor shaft of the motor, wherein the motor shaft is coupled to an impeller of the centrifugal compressor;

monitoring acoustic energy generated during operation of the centrifugal compressor using a microphone or an acoustic sensor, wherein the microphone or the acoustic sensor is disposed outside of a motor housing of the motor and on a radial side of the motor shaft of the motor;

processing the acoustic energy to remove any extraneous information;

comparing the acoustic energy to a predetermined value, wherein the predetermined value corresponds to a value of acoustic energy indicative of stable operation of the centrifugal compressor;

detecting occurrence of a surge condition in response to the acoustic energy exceeding the predetermined value during operation of the centrifugal compressor, wherein the occurrence of the surge condition corresponds to a complete reversal of flow in the centrifugal compressor; and adjusting at least one of a position of a variable geometry diffuser of the centrifugal compressor or a speed of the centrifugal compressor to remediate the surge condition in response to the surge condition being detected.

2. The method of claim 1, wherein detecting occurrence of the surge condition comprises detecting occurrence of the surge condition in response to the acoustic energy being 10 decibels greater than the predetermined value.

* * * * *